US009072933B1

(12) United States Patent
Huster

(10) Patent No.: US 9,072,933 B1
(45) Date of Patent: Jul. 7, 2015

(54) APPARATUS FOR EXERCISING INTRINSIC MUSCLES

(76) Inventor: Michael J. Huster, Fort Myers, FL (US)

( * ) Notice: Subject to any disclaimer, the term of this patent is extended or adjusted under 35 U.S.C. 154(b) by 220 days.

(21) Appl. No.: 13/470,931

(22) Filed: May 14, 2012

Related U.S. Application Data

(60) Provisional application No. 61/518,821, filed on May 12, 2011.

(51) Int. Cl.

| | |
|---|---|
| ***A63B 21/02*** | (2006.01) |
| ***A63B 23/08*** | (2006.01) |
| ***A63B 23/10*** | (2006.01) |
| ***A63B 21/04*** | (2006.01) |

(52) U.S. Cl.
CPC ..... *A63B 21/0442* (2013.01)

(58) Field of Classification Search
CPC ..... A63B 21/00; A63B 21/00003; A63B 21/00007; A63B 21/00079; A63B 21/00178; A63B 21/02; A63B 21/1423; A63B 21/143
USPC ..... 482/121–126, 92, 71, 51, 70, 72, 79, 482/80, 129–133, 135
See application file for complete search history.

(56) References Cited

U.S. PATENT DOCUMENTS

| | | | | |
|---|---|---|---|---|
| 4,373,716 | A * | 2/1983 | Pagani | 482/130 |
| 6,368,254 | B1 * | 4/2002 | Wall | 482/71 |
| D603,001 | S * | 10/2009 | Wong | D21/688 |
| 7,846,073 | B2 * | 12/2010 | Summers | 482/70 |
| 8,137,251 | B2 * | 3/2012 | Tozzi | 482/141 |
| 2002/0151417 | A1 * | 10/2002 | List | 482/123 |
| 2003/0216230 | A1 * | 11/2003 | Wang | 482/123 |
| 2004/0053752 | A1 * | 3/2004 | Yang | 482/70 |
| 2007/0117693 | A1 * | 5/2007 | Ilioi | 482/121 |
| 2010/0190621 | A1 * | 7/2010 | Palmer | 482/121 |
| 2010/0234192 | A1 * | 9/2010 | Oller, Jr. | 482/131 |

* cited by examiner

*Primary Examiner* — Loan H Thanh
*Assistant Examiner* — Megan Anderson
(74) *Attorney, Agent, or Firm* — William E. Noonan

(57) ABSTRACT

An apparatus for exercising intrinsic muscles of the lower and upper body includes a base having an elongate track mounted thereto. A pair of carriages carrying respective stirrups are adjustably mounted to the track. A pair of outer connector hooks are mounted to respective ends of the base and at least one inner connector hook is mounted to the base between the outer hooks. A height adjustable vertical post carries a horizontal hanger. Resilient athletic bands are connected to the apparatus and manipulated by a user to exercise intrinsic muscles.

20 Claims, 7 Drawing Sheets

APPARATUS FOR EXERCISING INTRINSIC MUSCLES

RELATED APPLICATION

This application claims the benefit of U.S. Provisional Patent Application Serial No. 61/518,821 filed May 12, 2011.

FIELD OF THE INVENTION

This invention relates to an apparatus for exercising intrinsic muscles. More particularly, the invention relates to a piece of exercise equipment for strengthening, conditioning, rehabilitating and otherwise developing the small intrinsic muscles of the hips and shoulders.

BACKGROUND OF THE INVENTION

Traditional strength and conditioning programs for the lower and upper body usually concentrate upon the development of large mule groups. For example, lower body exercise protocols typically focus on the gluteus, quadricep and hamstring muscles. By the same token, upper body exercise commonly targets large muscles such as the pectorals, latissiums dorsi and deltoids. Conventional exercise equipment and techniques tend to overlook smaller intrinsic muscle groups. These include, for example, the gracilis, gluteus minimus, adductor complex, iliacus, *piriformis* and other intrinsic muscles that contribute to the stability of the hip complex during regular and athletic movement. Strengthening these muscles can significantly improve athletic performance and help to reduce lower body injury. Likewise, developing and strengthening the intrinsic muscles of the upper body, such as the infraspinatus, *teres* minor and supraspinatus, helps to significantly strengthen the overall shoulder complex and reduces shoulder injuries of the type commonly experienced by both professional and amateur athletes. Because the intrinsic muscle groups of both the lower and upper bodies are frequently overlooked and not adequately developed, sports injuries continue to proliferate and linger to an unnecessarily great degree. Athletic performance is thereby adversely affected. Moreover, physical therapy and rehabilitation tend to be complicated and prolonged.

Although various exercise techniques and devices have been developed for conditioning specific intrinsic muscles, no single machine or exercise equipment is available for effectively strengthening a wide variety of virtually alt intrinsic muscle groups in both the upper and lower body. By the same token, there is no known piece of exercise equipment dedicated to developing small intrinsic muscle groups and suited for use as both a strength and conditioning tool to improve athletic performance and a rehabilitation and physical therapy tool to rehabilitate injuries. A great need exists for an apparatus exhibiting such versatility.

SUMMARY OF THE INVENTION

It is therefore an object of the present invention to provide an apparatus that allows the relatively small intrinsic muscle groups of both the hip complex and shoulder complex to be effectively, efficiently and comprehensively developed and strengthened.

It is a further object of this invention to provide an apparatus for exercising intrinsic muscles that allows a variety of virtually all intrinsic muscles in both the lower and upper body to be effectively strengthened and developed using only a single, piece of exercise equipment rather than requiring multiple pieces of equipment directed to respective intrinsic muscle groups.

It is a further object of this invention to provide an apparatus for exercising intrinsic muscle groups that may be used in a wide variety of settings including, but not limited to, athletic, workout, medical and rehabilitation facilities.

It is a further object of this invention to provide an apparatus for effectively strengthening and developing both upper and lower body muscle groups, including the hips and shoulders.

It is a further object of this invention to provide an exercise apparatus that is effective for use in strengthen and conditioning programs, physical therapy and chiropractic care.

This invention features an apparatus for exercising intrinsic muscles of the human body. The apparatus includes a lower base for being supported upon a floor or other underlying surface. The base carries an elongate track and a pair of stirrup components are mounted for moving longitudinally along the track. An opposing pair of outer connector elements are mounted to the base proximate respective ends of the track and at least one inner connector element is attached to the base between the pair of outer connectors. Each of the stirrups is for receiving a respective foot of a person using the apparatus. A resilient exercise band is selectively interengagable between a user's foot positioned on a respective stirrup and a corresponding one of the connector elements. This allows the user to perform an exercise by manipulating a foot received in the stirrup with a resilient exercise band interengaged between that foot and a respective one of the connector elements. A support post is attached to and extends upwardly from the base. The support post carries a hanger proximate an upper end thereof for supporting a resilient athletic band. The band is engagable by the hand or arm of a user to allow the user to exercise intrinsic muscles of the shoulder complex.

In a preferred embodiment, a second pair of inner connector elements are attached to the base between the first pair of opposing connector elements. A respective resilient exercise band is interengagable between each inner connector element and a foot positioned on an adjacent stirrup. The connector elements may include respective hooks.

Each stirrup may be supported, on a carriage that is slidably mounted to the elongate track. The elongate track may include a plurality of position holes spaced apart along the track. The carriage may include a complementary locking hole that is alignable with a selective one of the position holes formed in the track. A locking pin may be interengaged with the locking hole in the carriage and the aligned position hole in the track to lock the carriage and supported stirrup at a selected location on the track.

With the stirrup locked in a selected position on the track and a user's foot or ankle engaged with that stirrup, the user may perform intrinsic muscle exercise by interengaging a resilient band between the supported foot and either an inner or outer connector hook, and rotating the supported foot or respective leg against the resistance of that band. Adduction and abduction exercises may be performed by first engaging the feet with respective unlocked stirrups and interengaging a resilient band between each foot and a respective outer hook (for adduction) or inner hook (for abduction). Adduction is performed by squeezing the legs together. Abduction is performed by spreading the legs apart. Selected numbers of repetitions may be performed.

The support post may include an adjustable height. More particularly, the support post may include a fixed lower portion that is fastened to the base and an adjustable upper portion that is interengaged with and longitudinally adjustable relative to the lower portion of the post. The adjustable upper portion may be telescopically interengaged with the fixed lower portion. The fixed lower portion may include a locking hole and the adjustable upper portion of the post may include a series of spaced apart positioning holes. The upper portion of the post is longitudinally adjusted relative to the lower portion of the post to align a selected one of the positioning holes in the upper portion with the locking hole in the lower portion. A locking pin is interengaged with the aligned holes to interlock the upper and lower post portions relative to one another and thereby hold the post at a selected height.

A pair of post mounted connector elements may be, attached to and extend laterally outwardly from the post. Preferably, the post mounted connector elements are attached to the adjustable upper portion of the post and extend horizontally therefrom such that they are generally parallel to the elongate track. Each of the post mounted connector elements may include a hook. A respective resilient exercise band is selectively engaged with each post mounted hook. Each such band is engagable by a respective foot or leg of the user such that when the user is in a prone position, he or she can perform reflection of a respective hip.

A plurality of slots may be formed transversely in the adjustable upper portion of the post. Each such transverse slot may extend between a longitudinal side of the post and a respective positioning hole. These slots are for engaging a resilient athletic band, at least when the slot is disposed above the upper end of the lower post portion.

A counterbalancing assembly including one ore more weight plate holders May be utilized to stabilize the apparatus. The apparatus may be secured to an exercise or chiropractic table.

DETAILED DESCRIPTION OF PREFERRED EMBODIMENTS

Other objects, features and advantages will occur from the following description of a preferred embodiment and the accompanying drawings, in which.

Figure 1:
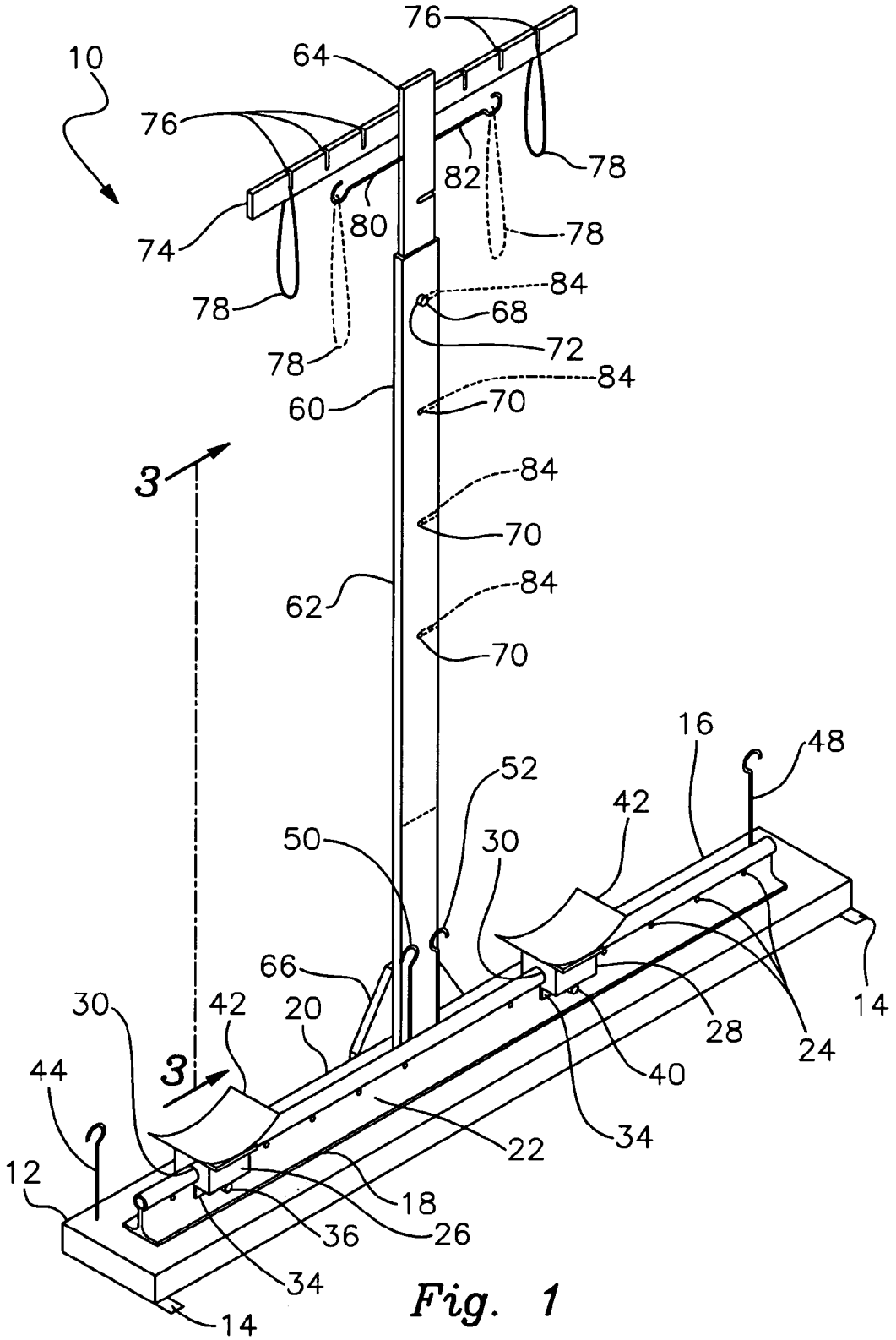
FIG. 1 is a perspective view of a preferred exercise apparatus in accordance with this invention.
Figure 2:
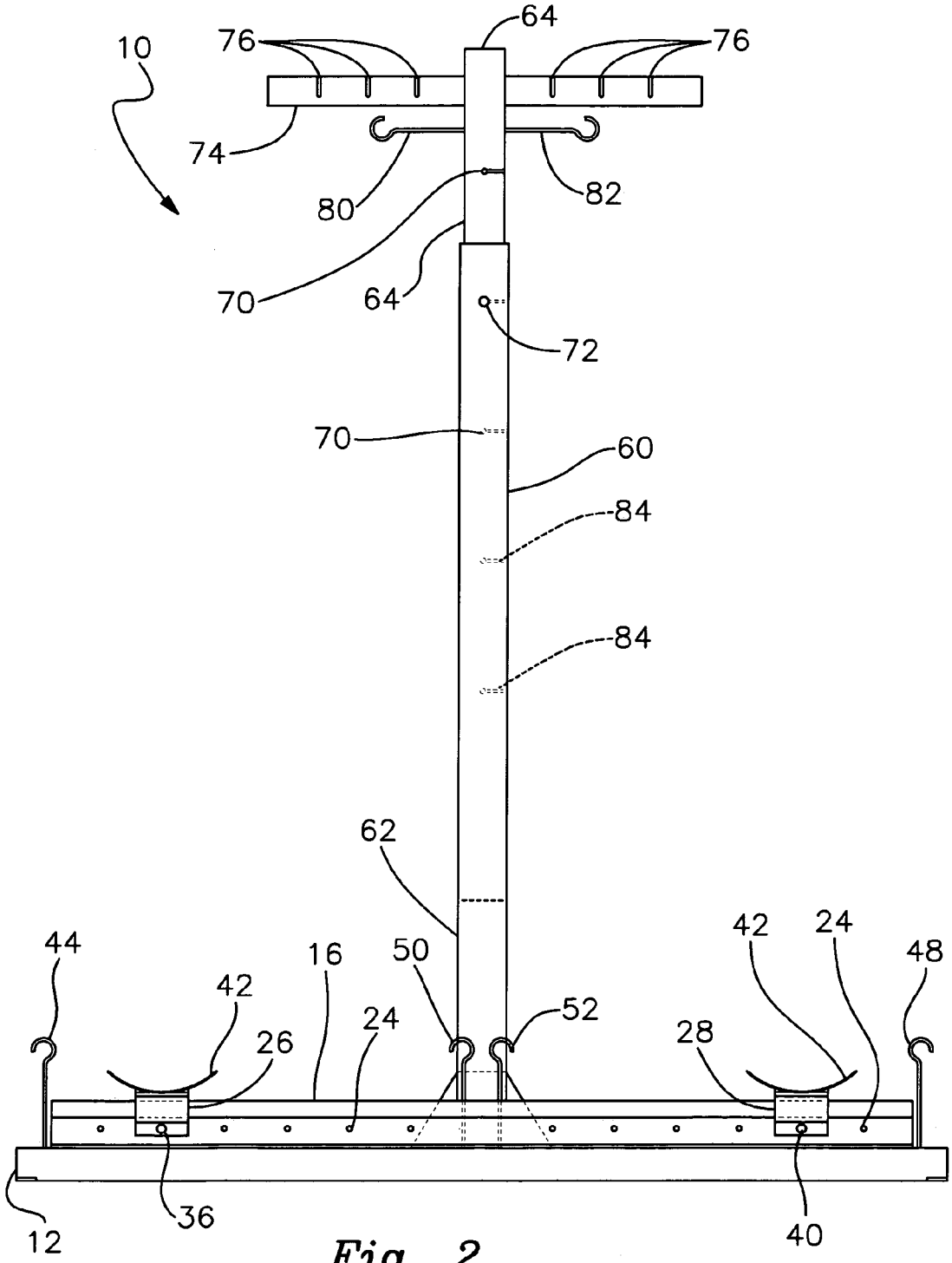
FIG. 2 is a front elevational view of the exercise apparatus.
Figure 3:
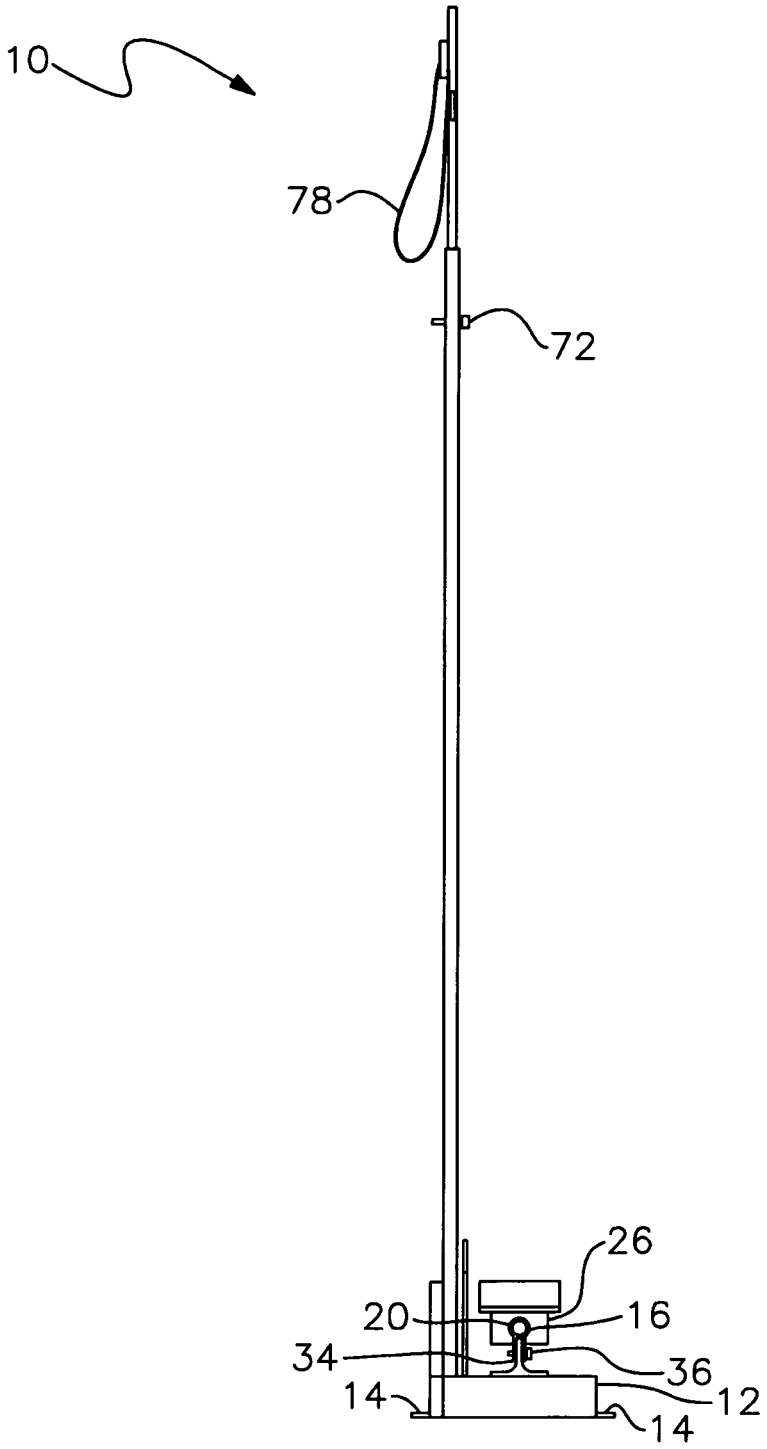
FIG. 3 is a side elevational view of the exercise apparatus.

There is shown in FIGS. 1-3 an exercise apparatus 10 for developing the intrinsic muscles of the upper and lower body. More particularly, apparatus 10 is designed for strengthening, conditioning, rehabilitating or otherwise exercising such muscles. The type of exercise or development for which the apparatus may be used should be construed broadly within the scope of this invention. In addition, apparatus 10 may be used for developing a wide variety of muscles and muscle groups both in, the upper and lower body. These especially include small, intrinsic muscles of the hip complex and shoulder complex. The particular muscles that may be exercised do not constitute a limitation of the invention.

Apparatus 10 features a lower base 12 including an elongate rectangular tube. Base 12 is preferably composed of steel although alternative metals, metal alloys and rugged synthetic materials may be employed. The base typically has a length of approximately 4', a height of about 2" and a width or depth of approximately 4". Alternative dimensions may be employed within the scope of this invention. The base should be configured to mount stably on a generally horizontal floor or other underlying surface (i.e. table, bench, mat, pad, etc). For example, feet or tabs 14 may be formed at each of the bottom corners of base 12. Suitable bolts, screws straps, brackets and/or other types of fasteners may be utilized to securely fasten the base to the underlying surface.

An elongate track 16 is mounted to the top surface of base 12. In particular, track 16 includes a bottom flange 18 that is bolted or otherwise fastened to the upper surface of the base. Track 16 further includes an elongate rail 20 that is supported above flange 18 by a generally vertical wall 22. The wall includes multiple (typically 8) positioning holes 24 that are spaced apart along wall 22 at intervals of approximately 6". Other numbers and spacings of positioning holes may be utilized. Rail 20 slidably supports a pair of stirrup supporting carriages 26 and 28. Each carriage may be composed of a durable metal or plastic material and includes a lower recess 30, which carries a sleeve-type bearing for engaging rail 20 and allowing the carriage to slide longitudinally along the rail. Various alternative types of bearings (e.g. needle bearings), roller systems and complementary interengaging surfaces may be utilized to allow the carriage to slide freely along rail 20. It should also be understood that the track may include various cross sectional configurations (e.g. dove tail) in accordance with this invention.

A parallel pair of flanges 34 depend from each carriage 26, 28 on respective sides of track wall 22. The parallel flanges 34 of each carriage include a pair of aligned locking holes 36. As the carriages 26 and 28 are moved along track 16, the aligned holes 36 are themselves aligned with a selected positioning hole 24 in track wall 22. A locking pin 40 having a T handle is engaged with the aligned locking holes 36 and positioning hole 24 to secure each carriage at a selected position along track 16. The purpose of such positioning is described more fully below.

Each carriage 26 and 28 carries a curved, foot supporting stirrup 42 that is mounted to the top of the carriage. Each stirrup 42 comprises a quarter circular piece of metal that is coated in a non-slip material. Stirrups 42 may have alternative configurations and constructions, although they should be sized and configured to comfortably and securely receive respective feet, ankles and/or legs of the user. The stirrups and carriages may be machined integrally or in separate pieces that are attached by various types of fasteners or connective means such as bolts, welding, grooves and complementary fitted inserts, etc.

A plurality of lower exercise band retaining connector elements comprising respective retaining hooks are secured to base 12. In particular, an exterior pair of hooks 44 and 48 are mounted proximate respective opposite ends of base 12. Each of hooks 44 and 48 is positioned just beyond a respective end of track 16. More particularly, each hook 44, 48 includes an elongate shaft having a lower threaded end that is received through an opening in the top surface of base 12 and is fastened in place by an appropriate nut. The shaft extends upwardly and terminates in a hooked upper end. Hooks 44 and 48 may be axially turned or rotated to orient the upper hooked ends of those elements as desired. Alternative preferred retaining hooks, which are horizontally oriented, may be used for these connectors as described below.

A second, interior pair of similarly constructed hooks 50 and 52 are fastened in an analogous manner adjacent to one another and proximate the longitudinal center of base 12. Hooks 50 and 52 are thereby positioned intermediate opposing hooks 44 and 48 and are inside of track 16 (i.e. behind the track in FIGS. 1 and 2). Once again, hooks 50 and 52 may be turned or rotated within the base to orient the hooked upper ends as desired.

Apparatus 10 further includes a vertical post. 60 that includes a fixed lower post section 62 and an upper post section 64 that is slidably and longitudinally interengaged with lower post section 62. More particularly, the lower post section includes an elongate piece of rectangular steel tube that is fixedly attached to and extends vertically upwardly from the hidden longitudinal wall of base 12. Post section 62 may have various dimensions (i.e. 2"×4", 2" square, etc.) within the scope of this invention. In addition, lower post section 62 has a preferred height of approximately 4', although this too may be varied. Post section 62 is secured to base 12 by an outer bracket 66 that is fastened to both post section 62 and base 12 by bolts engaged with corresponding holes in the respective components and secured in place by appropriate nuts. Other forms of attachment may be used for fixedly securing the lower post section 62 to the base.

Adjustable upper post section 64 has a cross sectional configuration that generally conforms to that of lower post section 62, but which is slightly smaller in size such that upper section 64 is slidably received in lower section 62. The upper section has a length of approximately 3', although this again may be varied within the scope of this invention. Post sections 62 and 64 are thereby telescopically interengaged. Upper section 64 is adjustable within lower section 62 such that it may be either raised to lengthen or lowered to reduce the height of post 60.

A docking hole 68 is formed through the forwardly facing wall of lower post section 62 proximate an upper end of that section. A plurality of selectively corresponding height adjustment holes 70 (five such holes in the disclosed embodiment) are formed through upper post section 64. Holes 70 are positioned through post section 64 such that the upper post section may be longitudinally adjusted to align a selected one of holes 70 with locking hole 68 in lower post section 62. A spring loaded pin 72 is engaged with the aligned holes to hold the upper post section 64 at a selected position within lower post section 62. As a result, post 60 may be locked in place at a selected height.

An elongate hanger bar 74 is attached, to upper post section 64 above and exteriorly of lower post section 62. The hanger bar extends perpendicularly across upper post section 64 and is secured thereto by bolts, screws or other known fastening means. The hanger bar includes a spaced apart series of vertical slots 76 that are formed in the top edge of hanger 74. Each slot 76 is capable of receiving a respective resilient athletic band 78. Such bands comprise known types of stretchable athletic bands, such as Theraband™ which are conventionally known and used for exercise and physical therapy. Slots 76 allow one or more of such bands to be securely engaged with and connected to hanger bar 74 so that the user may pull against the band(s) to perform a selected exercise in the manner described more fully below.

A third, upper pair of connector hooks 80 and 82 are secured to and extend transversely outwardly in opposite directions, from respective longitudinal sides of upper post section 64. Hooks 80 and 82 are constructed analogously to the previously described connector hooks. Hooks 80 and 82 are carried by post section 64 above and exteriorly of lower post section 62, but below hanger bar 74. These hooks are connected to post section 64 in a manner similar to that by which hooks 44, 48, 50 and 52 are secured to base 12. The outer, hooked ends of hooks 80 and 82 are selectively engaged by respective stretchable athletic bands 78. This provides the user with additional options for positioning the bands to perform selected exercises targeting respective muscle groups. Each connector hook 80, 82 may be axially rotated relative to post 60. This allows the connector hook 80, 82 to be oriented in a selected manner (i.e. with the hook end open upwardly) for attaching a resilient exercise band to the hook and allowing that band to be stretched to exercise a selected muscle group.

As best shown in FIGS. 1 and 2, a spaced apart plurality of horizontal hanger slots 84 are formed laterally in upper post section 64. In particular, each slot 84 extends from a longitudinal vertical side of post Section 64 to a respective one of height adjustment holes 70. When post section 64 is raised to expose one or more of holes 70 above post section 62, the slot or slots 84 adjoining these exposed holes are likewise exposed. This provides further slots which the user may employ to operably engage resilient exercise bands to the upper post 60 in the manner shown in FIG. 1.

Apparatus 10 is advantageously used in various applications (e.g. strength, conditioning, rehabilitation, etc.) to exercise the small intrinsic muscles of the lower and upper bodies, i.e. the hip and shoulder complexes respectively. Apparatus 10 is particularly utilized for exercise by interengaging one or more resilient athletic bands with respective hooks or slots of the apparatus and stretching the band(s) to exert a tension that effectively exercises targeted muscles. Working against resilient band resistance in this manner is known in the exercise field. The bands may be attached to various locations of apparatus 10 including any of the hanger bracket slots, vertical post slots and connector hooks and then stretched/manipulated by the user in a known manner to achieve beneficial exercise results.

Lower body exercises are performed with the user lying prone or horizontally on the underlying floor surface in front of apparatus 10. Internal or external rotation of the intrinsic muscles of the hip complex is performed by first positioning and locking the slidable carriages 26 and 28 at selected positions along track 16. Specifically, the locking pin 40 is disengaged from the parallel flanges 34 of each carriage 26, 28 and the carriages are positioned to align the locking holes 36 with a selected positioning hole 24 in the track. The locking pins 40 are then re-engaged with the respective carriages to lock the carriages in the selected positions along the track. Such positions are chosen to allow a maximum range of motion for the user.

After carriages 26 and 28 are locked in position at selected locations along track. 16, the user engages resilient exercise bands, as previously described, with one or more of connector hooks 44 48, 50 and 52. The user then lies horizontally in front of apparatus 10, places his or her foot, ankle, or lower leg onto a respective stirrup 42 and interengages a resilient band between a selected connector hook and the supported foot or ankle. The user then performs one or more of the following rotational exercises, which are typically targeted at strengthening/conditioning small intrinsic muscles of the hip complex and/or correcting dysfunctions of the lower body such as pronation distortion syndrome and excessive external or internal hip rotation. These types of dysfunctions, which place an athlete or other person at significant risk for ACL tears, are selectively corrected in many cases through the following exercises.

Figure 4:
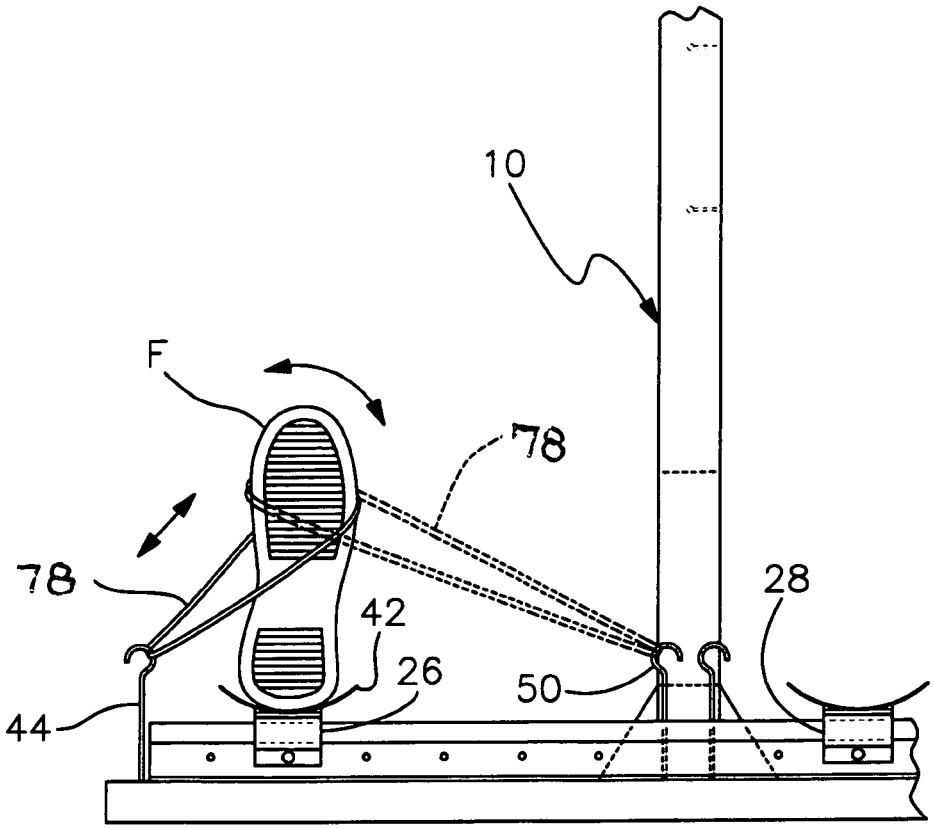
FIG. 4 is a fragmentary view of the apparatus particularly illustrating how the apparatus is used to rotationally exercise the intrinsic muscles of the hip complex.

Internal rotation involves placing the user's heels in respective stirrups 42 of the locked carriages. A resilient band is wrapped around each of exterior hooks 44 and 48. FIG. 4 depicts a representative user's foot F mounted, in the foregoing manner, in stirrup 42 of carriage 26 with a resilient band 78 interengaging hook 44. Band 78 is also wrapped about the inside of foot F, typically around the toes. It should be understood that a second resilient band may be similarly interengaged between the opposite exterior connector hook 48 (not shown in FIG. 4) and the user's other foot (likewise not shown) which is mounted on the stirrup of locked carriage 28. To perform internal rotation exercises, the user keeps his or her legs, knees or ankles locked and rotates the foot F internally (i.e., in a clockwise direction in FIG. 4) against the resistance of the stretchable band. This causes band 78 to stretch. As a result, the internal rotators of the hip complex (i.e. the grasilis, adductor complex and anterior gluteus minimus muscles) are targeted. Various numbers of repetitions and exercise sequences may be performed as needed or desired. The muscles in each side of the user's hips may be exercised in an analogous manner.

External rotation of the muscles in the hip complex is performed analogously with the user assuming the same position relative to apparatus 10. Specifically, the user engages each heel with a respective one of the locked stirrups. A resilient band 78 is then interengaged between a respective one of the inner connector hooks, i.e. hook 50 in FIG. 4, and the outside of a corresponding supported foot F. The user rotates foot F in a counterclockwise direction, i.e. against the tension of band 78, while maintaining the legs, knees and ankles in a locked condition. Such rotational exercise targets the gluteus maximus and periformis muscles. It should be understood that either of the above-described internal and external rotation can be performed with the knees in either straight or bent conditions. By bending the knees, the joint angles of the targeted muscles are changed to alter the focus of the exercise somewhat.

Ankle inversion exercise may be performed with the user in the same position as described above. In this case, the band 78 is again interconnected between an outer hook, e.g. hook 44, and the inside of foot F. However, in this case, only the ankle joint is rotated in a clockwise direction. As a result, muscles of the hip complex including, but not limited to, the tibialis anterior, tibialis posterior and extensor hallucis longus are targeted.

Ankle eversion is performed by interengaging band 78 between the inner hooks 50, 52 and the outside of respective feet F. The supported feet are rotated in a counterclockwise direction at the ankle only to exercise the peroneals, extensor digitorium, longus, etc.

It should be understood that for any of the foregoing exercises, selected numbers of repetitions and sequences may be used to achieve the desired degree of strength, conditioning, rehabilitation, etc. Exercise speeds, interval durations, band resistances and other known types of exercise parameters may also be varied within the scope of this invention. It should also be understood that, in alternative embodiments, a single inner connector hook may be used instead of the two inner connector hooks 50, 52 shown herein. In such cases, the respective sides of the hip complex are exercised successively and the single inner hook is simply turned to allow a band to be interconnected between the hook and the user's respective feet.

Abduction and adduction exercises are performed with the user again lying horizontally on the ground and extending perpendicularly in front of base 12. In this series of exercises, carriages 26 and 28 are not locked onto track 16 but rather are freely slidable along the track. Adduction and abduction can then be performed in the following manner to correct dysfunctions of the lower body such as pronation distortion syndrome and excessive external/internal hip rotation.

Figure 5:
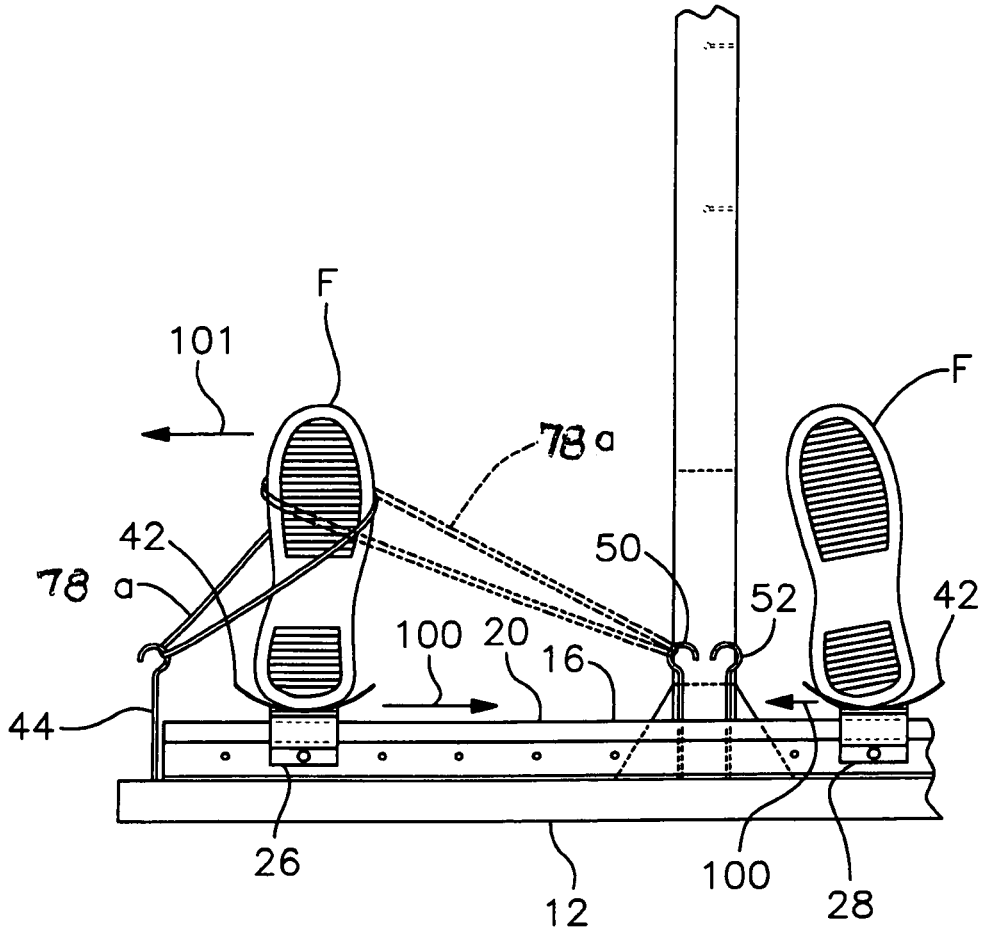
FIG. 5 is a fragmentary view of the apparatus wherein adduction and abduction are performed.

To perform adduction, the heels are again placed in respective stirrups 42 of carriages 26 and 28 in the representative manner shown in FIG. 5. A resilient band 78*a* is interengaged between each of the outer connector hooks 44 and 48 (only hook 44 is shown in FIG. 5) and an inside of a respective foot F. The user performs adduction by squeezing his or her legs together, as indicated by arrows 100. Carriages 26, 28 are unlocked and are free to slide along rail 20 of track 16. This stretches band 78*a* and thereby exercises muscles including the gracilis, pectineus, adductor, longus, *brevis* and magnus.

To perform abduction the user's heels are again placed in respective stirrups 42 with the carriages 26, 28 unlocked and slidable along track 16. A band 78*a* is interengaged between each of the user's feet F and a respective one of inner hooks 50, 52. Carriages 26 and 28 are positioned proximate the center of base 12 and track 16. The user performs abduction by spreading his or her legs apart, as represented by arrow 101, while maintaining the legs in a straight condition. The legs are pulled against the resistance of interengaged bands 78*a* to exercise muscles including the gluteus minimus, gluteus medius, TFL and piriformus. A selected number of repetitions may be performed in accordance with various selected exercise protocols. It should be noted that either abduction or adduction may also be performed with bent knees.

Apparatus 10 also allows the user to perform hip extension and flexion exercises. Once again, for either exercise, the user lies horizontally on the floor or other underlying surface in front of apparatus 10 and extending generally perpendicularly thereto. To perform hip extension, the user engages one or both of his or her feet with a respective exercise band 78, FIG. 1, attached to one of horizontal connector hooks 80 and 82. The user lowers an engaged leg against the resistance of the attached band 78 to perform hip extension on a respective side of the hip complex.

Analogously, hip flexion is performed with the user again lying in front of and extending perpendicularly from apparatus 10. For this exercise, a respective resilient band is interconnected between the user's ankle and a corresponding one of the inner connector hooks 50 and 52. With the band so engaged, the user raises his or her leg against the band resistance. Hip flexion is thereby performed.

The small muscles of the shoulder complex are exercised using apparatus 10 with the user maintaining a standing position. In particular, the user stands in front of post 60 and exercises muscle groups of the shoulder complex by manipulating (pulling and stretching) resilient athletic bands 78 attached as previously described to either horizontal hanger bar 74 or upper post section 64. This allows the user to develop muscles of the shoulder complex, which are responsible for preventing impingement syndromes, as well as stabilizing the very unstable shoulder complex. In particular, shoulder injuries such as rotator cuff tears can be effectively rehabilitated and/or the small intrinsic muscles of the shoulder complex can be strengthened/conditioned to avoid such injuries, particularly during athletic performance. The following are representative types of exercises performed using apparatus 10 that target the upper body.

The top end of upper post section 64 may be adjusted to be approximately level with the top of the user's head. Horizontal connector hooks 80 and 82 are set to approximately shoulder width. Resilient bands are attached to hooks 80 and 82 with the user holding the other end of each band. The user's humerus (upper arm) is oriented generally parallel to the floor and the elbow is maintained at 90° of flexion. The user then rotates the shoulder joint in a front to back rotation. This exercises the infra pinatus, *teres* minor and supra spinatus muscle groups.

In a second type of upper body exercise, vertical post 60 is lowered such that its upper end is at, approximately waist level. Resilient bands are again engaged with either respective slots 76 of hanger bar 74 or connector hooks 80, 82. The user maintains his or her upper arms parallel to the sides of the torso with an elbow flexion of 90°. The user again rotates the shoulders front to back. This exercises the infra spinatus, *teres* minor and supra spinatus muscle groups.

In still another upper body exercise, the upper end of post 60 is adjusted to shoulder height. The user holds his or her arms parallel to the floor with, no elbow flexion. Resilient bands are again engaged with either the hanger bar or with the horizontal connector hooks. The user grasps the bands and pulls them against the bands' resistance such that the arms move from generally perpendicular to the torso to parallel to the torso. As with all of the exercises described herein, assorted numbers of repetitions, interval durations, band resistance levels and exercise protocols may be employed.

In addition to the mounting tabs described herein, other types of connectors and means for attachment may be used for securing apparatus 10 to the wall and/or floor of an exercise facility. Various types of straps, struts or brackets may be utilized to secure the post and/or base to the wall. In addition, a counterbalance bracket, as described below, may extend rearwardly from the base to engage the floor and further reduce the chance that apparatus 10 will tip during usage. Preferably, the apparatus is bolted or otherwise fixed to the floor and/or wall of the exercise facility.

Figure 6:
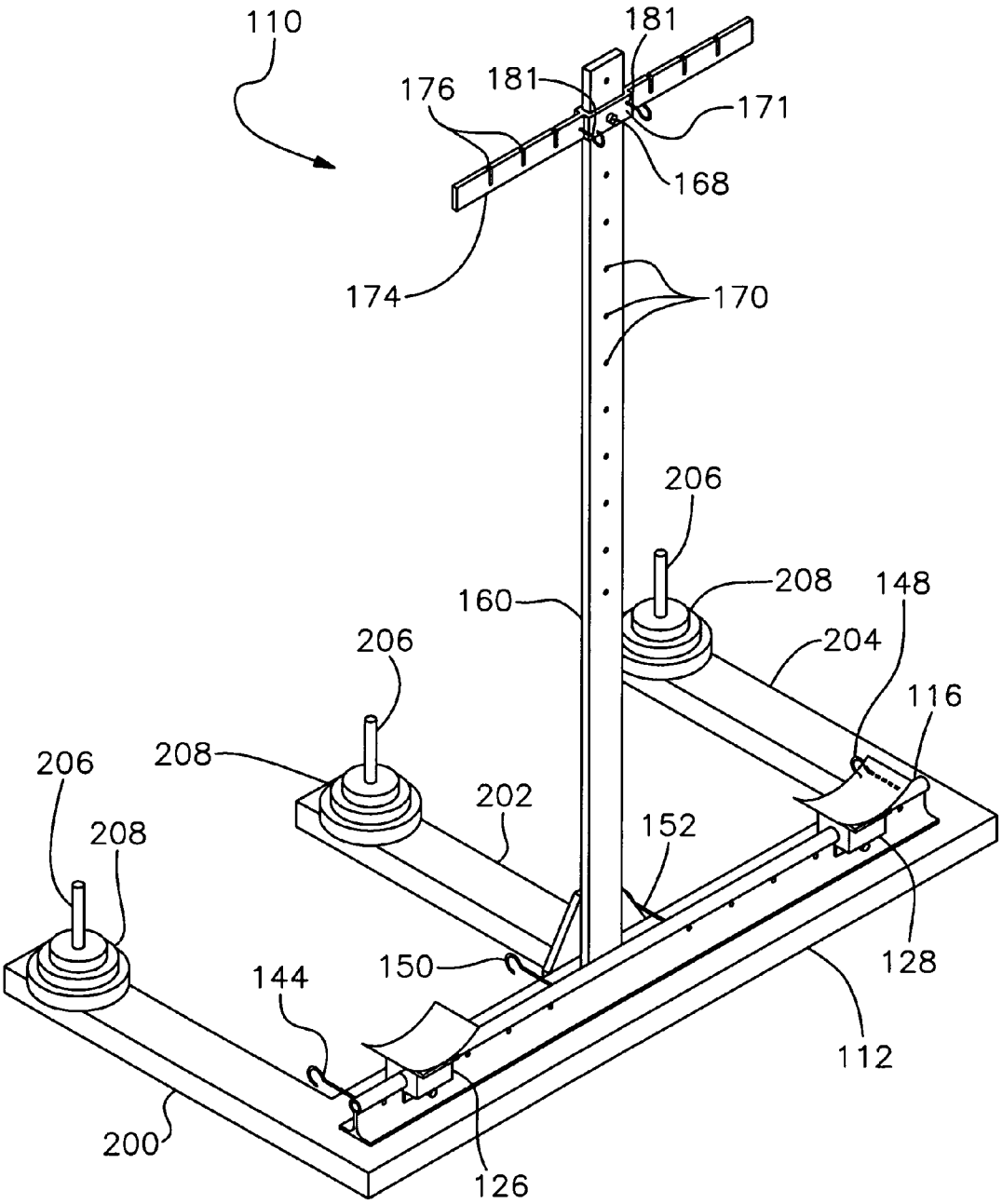
FIG. 6 is a perspective view of an alternative preferred version of the exercise apparatus.
Figure 8:
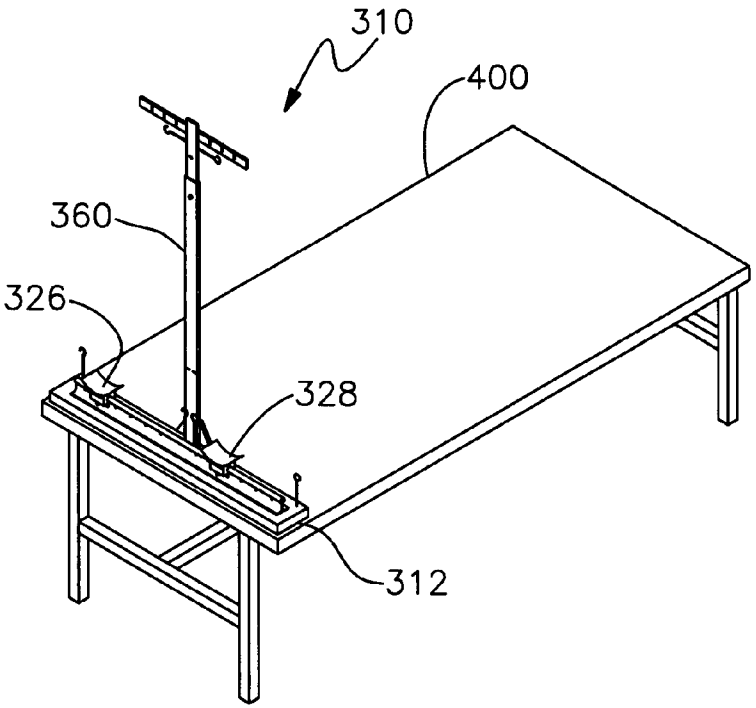
FIG. 8 is a perspective view of the apparatus as mounted on an exercise table.
Figure 7:
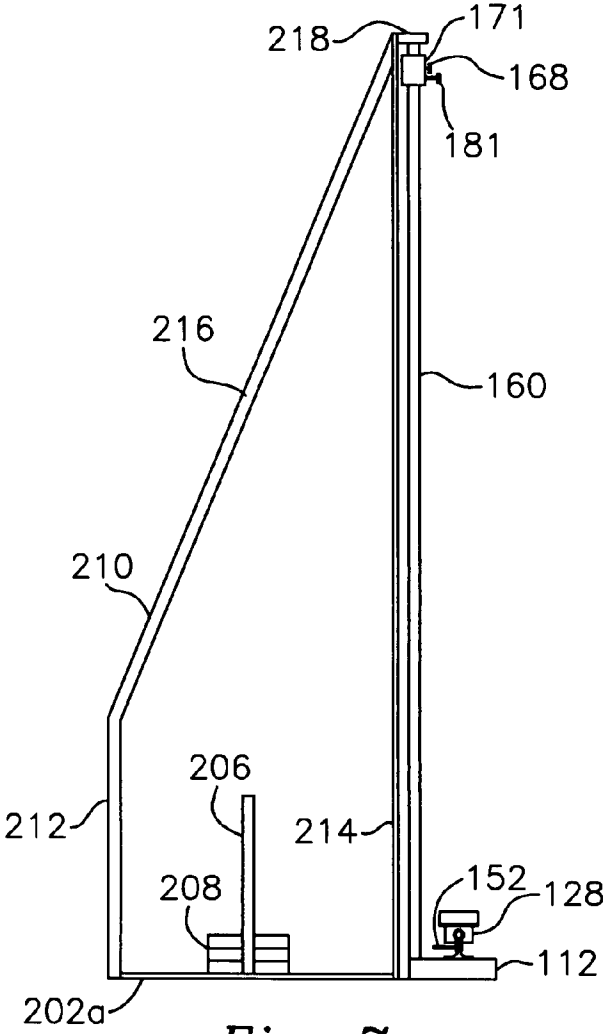
FIG. 7 is a cross sectional view of another alternative embodiment of the apparatus.

FIGS. 6-8 depict alternative embodiments of the exercise apparatus of this invention. Apparatus 110, shown in FIG. 6, again includes a floor mounted base 112 that supports an elongate track 116. A pair of stirrup-supporting carriages 126 and 128 are slidably mounted on track 116 in the manner previously described. Likewise, the carriages are selectively locked in respective discrete positions along the track. The releasable locking mechanism previously described is again used in this version.

A number of alternative preferred features are incorporated into the version shown in FIG. 6. In particular, lower outer connectors 144, 148 (the latter in phantom) and lower inner connectors 150, 152 (again depicted in phantom) comprise horizontally oriented retaining elements or hooks. These connector elements may comprise a threaded bolt that carries a complementary threaded nut or cap that effectively defines a hook for receiving and retaining a respective exercise band. The lower connector elements are secured to the track 120 such that they do not interfere with the movement of carriages 126 and 128. For example, outer connectors 144 and 148 are secured to the track outwardly of the respective carriages 126 and 128. Inner connectors 150 and 152 are attached to the track inwardly of the range of movement of the respective carriages. In each case, the lower connectors extend horizontally and rearwardly from the track. These retaining, connectors are readily and easily interengageable by resilient exercise bands in the manner previously described. They exhibit an unobtrusive and ergonomic low profile, and are convenient and easy to access. The positioning of the connectors permits the user to conveniently and effectively attach and manipulate the resilient exercise bands so that the intrinsic muscles of the hip complex can be exercised effectively.

Apparatus 110 features a one-piece support post 160 that is provided with a spaced apart series of positioning holes 170 for use in setting hanger bar 174 at a selected height. In this version, the hanger bar includes a collar 171, which is also depicted in the embodiment shown in FIG. 7. The collar comprises a slot formed through the elongate hanger bar, which receives the support post 160. The hanger employing a collar, as described in FIGS. 6 and 7, is typically lighter in weight than the previously described crossbar. The post and hanger of this version are also easier to clean and maintain in this version.

As shown in FIGS. 6 and 7, a locking pin 168 is selectively engaged with a locking hole formed in hanger 174 and an aligned one of the positioning holes 170 in post 160. This allows the hanger bar to be vertically adjusted in a quick and convenient manner and locked in place at a selected height along post 160. Any number of holes and any desired spacing may be formed along post 160 for part or the entire length of the post.

Hanger 170 again includes slots 176 formed in the upper edge of the hanger bar for connecting a resilient exercise band to the hanger in the manner previously described. This allows the user to exercise his or her intrinsic muscles in the upper body and more particularly in the arms and shoulder complex. A pair of horizontally oriented retainer hooks 181, which are analogous to the lower connectors 140, 148, 150 and 152, are attached to and extend forwardly from hanger 174. Each upper connector 181 is likewise engageable by a resilient exercise band. The band is then engaged by a respective leg of the user, who stretches the engaged band downwardly in order to perform hip extension, as previously described.

As shown in FIGS. 6 and 7, the exercise apparatus of this invention may employ a counterbalancing structure top improve the stability of the apparatus. As shown in the version in FIG. 6, such counterbalancing may be accomplished by a plurality of lower bars 200, 202 and 204 that are attached to and extend rearwardly from base 112. Bar 202 extends generally from the center post 160 and bars 200 and 204 extend rearwardly from respective ends of base 112. The bars may comprise a flat piece of steel or another suitable metal or metal alloy. Each bar supports a vertical weight plate mounting rod 206. Each mounting rod accommodates one or more standard weight plates 208 having a central opening through which rod 206 extends. Weights may be added or removed as desired to provide a needed degree of counterbalancing and to prevent the exercise apparatus from tipping during usage.

An alternative counterbalancing construction is shown in the cross sectional view of FIG. 7. Therein a central bar **202*a* extends rearwardly from the base 112 proximate support post 160. Elongate bars or strips of a strong and sturdy metal material may be interconnected to bar 202*a* to form a counterbalancing framework 210. In particular, vertical pieces 212 and 214 may extend upwardly from bar 206*a* and may be interconnected by a diagonally disposed piece 216. Pieces 214 and 216 may be joined to a cap 218 at the top of post 160. Once again, a rod-like plate holder 206*a* may be secured to and extend upwardly from bar 202*a* for supporting one or more standard weight plates 208. Otherwise, the parts shown in FIG. 7 are numbered analogously to the previously described, version depicted in FIG. 6**.

In FIG. 8, a modified exercise apparatus 310 in accordance with this invention is mounted to one end of an exercise table 400. Base 312, which may be flat or have an L-shaped cross sectional configuration, is mounted by bolts, brackets or other means of attachment proximate one end of table 400. Stirrup-supporting carriages 326 and 328 are movably mounted on a track carried by the base, as previously described. The post 360 typically had a height of about 4 feet. Otherwise, apparatus 310 is constructed and operates analogously to the versions previously described. No counterbalancing is needed for this embodiment due to attachment of apparatus 310 to table 400.

The version in FIG. 8 is particularly effective for use by chiropractors and as an attachment to a standard physical therapy table. The attached apparatus 310 increases the variety and scope of rehabilitative exercises available to the user and provides for much more effective concentration on the rehabilitation of small intrinsic muscles and muscle groups by utilizing the exercises such as described above.

The apparatus of this invention exhibits greatly improved versatility. Assorted lower and upper body exercises may be performed on a single machine. This eliminates the expense and duplication associated with acquiring multiple machines for targeting respective individual muscle groups. The apparatus of this invention allows a wide variety of small muscle groups in both the hip and shoulder complexes to be effectively strengthened, conditioned, rehabilitated or otherwise developed on a single, cost effective piece of exercise equipment. The apparatus features few moving parts and, as a result, equipment malfunction and resultant repairs are largely avoided.

The apparatus of this invention is particularly effective, in correcting weaknesses and dysfunctions in and below the hip complex. As a result, lower back pain and other chronic conditions are successfully addressed. The apparatus may be used in a, wide variety of beneficial applications including, but not limited to strength and conditioning programs, physical therapy, rehabilitation and chiropractic therapy. The apparatus may be featured at a wide variety of athletic and training facilities, clinics, rehabilitation facilities, etc. The particular uses to which the apparatus may be put and venues in which the apparatus may be installed are not limitations of this invention.

Accordingly, this invention relates to a versatile apparatus for effectively exercising intrinsic muscles of both the lower and upper body. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An apparatus for use in combination with one or more resilient exercise bands to exercise intrinsic muscles of the user, said apparatus comprising:

a base for being supported on a generally horizontal surface, said base carrying an elongate track, said track having at least one set position situated along said track;

a carriage supported to slide selectively in a pair of opposing longitudinal directions along said track without disengaging said track during use;

a lock that is releasably interengageable with said track at a selected said set position to restrict sliding of said carriage in each of the opposing longitudinal directions along said track such that said carriage is locked in said selected set position;

a stirrup component carried by said carriage, said stirrup component for supporting a foot of the user with the toes of the supported foot pointing generally upwardly from said stirrup component; and at least one connector carried by said base for being engaged by a resilient exercise band to secure one end of the exercise band in place such that an opposite end of the exercise band is releasably attachable to the user's foot supported in said stirrup component and the resilient exercise band is interengaged, in its entirety, between said connector and the user's supported foot, whereby the user is able to rotate the supported foot against the attached exercise band to stretch the exercise band and exercise the intrinsic muscles of the user's lower body when said carriage is locked in said selected set position.

2. The apparatus of claim 1 in which one or more positioning holes are spaced along said track to respectively define said discrete positions on said track and a complementary locking hole is formed in said carriage and alignable within a selected said positioning hole, said lock including a locking pin that is interengaged with said locking hole and an aligned said positioning hole to lock said carriage and said stirrup at a selected set position on said track.

3. The apparatus of claim 1 further including an elongate support post attached to and extending vertically upwardly from said base and an elongate hanger attached and extending transversely to said post, said hanger carrying at least one upper connector engageable by the respective exercise band, in which the exercise band is engagable by the user and manipulated to stretch the exercise band and exercise intrinsic muscles of the user.

4. The apparatus of claim 3 in which said upper connector includes a slot for receiving the exercise band.

5. The apparatus of claim 3 in which said support post includes a one-piece construction and said hanger carries a collar that movably receives said support post and allows said hanger to be positionally adjusted along said post, and further including an upper locking mechanism for releasably holding said hanger at a selected position and height along said post.

6. The apparatus of claim 5 in which said upper locking mechanism includes a plurality of positioning holes spaced along said post, a locking hole formed in said collar and a locking pin that is insertible through said locking hole and a selected aligned positioning hole.

7. The apparatus of claim 5 in which said upper connector includes a retainer hook element extending generally horizontally from said hanger.

8. The apparatus of claim 1 in which said lower connector includes a retainer hook element that is attached to and extends generally vertically from said base.

9. The apparatus of claim 1 in which said stirrup component is concavely configured to receive and support the user's foot such that said stirrup permits rotation of said supported foot against the resilient exercise band when said carriage is locked in said selected set position and alternatively constrains said supported foot within said stirrup when said lock is released and during sliding of said carriage and the supported foot along said track.

10. An apparatus for use in combination with one or more resilient exercise bands to exercise intrinsic muscles of the user, said apparatus comprising:

a base for being supported on an underlying surface, said base carrying an elongate track, said track having a plurality of discrete, spaced apart set positions arranged longitudinally along said track;

a pair of carriages supported by said track, each carriage being slidable selectively in a pair of opposing longitudinal directions along said track without disengaging said track during use;

a pair of locks, each said lock being releasably interengageable with said elongate track and a respective said carriage at a selected said set position on said track to restrict sliding of said respective carriage in each of the opposing longitudinal directions along said track such that said respective carriage is locked in said selected set position;

each said carriage supporting a respective stirrup component, each said stirrup component for supporting a respective foot of the user with the toes of that foot pointing generally upwardly from the stirrup component; and an outer pair of lower connectors carried by said base proximate respective ends of said track and at least one lower connector carried by said base inwardly of and between said outer pair of lower connectors, each said lower connector for being engaged by a resilient exercise band to secure one end of the band in place such that an opposite end of the exercise band is releasably attachable to a respective foot of the user supported by a respective said stirrup component and the resilient exercise band is interengaged, in its entirety, between said lower connector and the user's supported foot, whereby the user is able to perform abduction and adduction exercises by supporting each of the user's feet on a respective said stirrup component and sliding said respective carriages longitudinally along said track without disengaging said carriages from said track when said locks are released from said track and, alternatively, the user is able to rotate the respective supported foot against the attached exercise band to stretch the exercise band and exercise intrinsic muscles of the user's lower body when the carriage is locked in the selected set position.

11. The apparatus of claim 10 in which an inner pair of lower connectors are carried by said base inwardly and between said outer pair of connectors.

12. The apparatus of claim 10 in which a plurality of positioning holes are spaced along said track to respectively define said plurality of set positions on said track and a complementary locking hole is formed in each said carriage and alignable with a selected said positioning hole in said track, said lock including a locking pin that is interengaged with said locking hole and an aligned one of said positioning holes to lock said carriage and said supported stirrup at a selected set position on said track.

13. The apparatus of claim 10 further including an elongate support post attached to and extending vertically upwardly from said base and an elongate hanger attached and extending transversely to said post, said hanger carrying at least one upper connector that is engageable by a respective exercise band, which band is engaged by the user and manipulated to stretch the engaged exercise band and exercise intrinsic muscles of the user.

14. The apparatus of claim 13 in which at least one said upper connector includes at least one slot formed in an upper edge of said hanger and a retainer hook extending generally horizontally from said hanger.

15. The apparatus of claim 13 in which said support post includes a one piece construction and said hanger carries a collar that movably receives said post and allows said hanger to be positionally adjusted along said post and further including an upper locking mechanism for releasably holding said hanger at a selected position and height along said post.

16. The apparatus of claim 15 in which said upper locking mechanism includes a plurality of positioning holes spaced along said post, a locking hole formed in said collar and a locking pin that is insertible through said locking hole and a selected aligned positioning hole.

17. The apparatus of claim 10 in which said lower connector includes a retainer hook attached to and extending generally vertically from said base.

18. The apparatus of claim 10 in which said stirrup components are concavely configured to support the user's respective feet such that each said stirrup permits rotation of a supported foot against the attached exercise band when said carriage supporting said stirrup is locked in said selected set position and alternatively constrains the supported foot within said stirrup when said carriage supporting said stirrup is unlocked and during sliding of said carriage and the supported foot along said track.

19. An apparatus for exercising the intrinsic muscles of a user, said apparatus comprising:

a base for being supported on an underlying surface, said base carrying an elongate track, said track having a plurality of discrete set positions spaced apart longitudinally along said track;

a pair of carriages supported by said track, each said carriage being slidable selectively in a pair of opposing longitudinal directions along said track without disengaging said track during use;

a pair of locks, each said lock being releasably interengageable with said track and a respective said carriage at a selected said set position on said track to restrict the sliding of said respective carriage in each of the opposing longitudinal directions along said track such that said carriage is locked in said selected set position on said track;

each said carriage supporting a respective stirrup component, each stirrup component for supporting a respective foot of the user with the toes of that foot pointing generally upwardly from said stirrup;

at least one resilient exercise band;

an outer pair of lower connectors carried by said base proximate respective ends thereof and at least one lower connector carried by said base inwardly of and between said outer pair of lower connectors, each said lower connector for being engaged by a respective said exercise band to secure one end of said band in place such that an opposite end of said exercise band is releasably attachable a respective foot of the user supported by a respective said stirrup component and said exercise band is interengaged, in its entirety, between said lower connector and the user's supported foot, whereby the user is able to perform abduction and adduction exercises by supporting each of the user's feet on a respective said stirrup component and sliding said respective carriages longitudinally along said track without disengaging said carriages from said track when said locks are released from said track and, alternatively, the user is able to rotate the supported foot against the attached exercise band to stretch said exercise band and exercise intrinsic muscles of the lower body;

an elongate support post attached to and extending upwardly from said base; and an elongate hanger attached to and extending transversely to said post, said hanger carrying a plurality of upper connectors, each said upper connector being engageable by and for retaining an exercise band, which band is engaged by a user and manipulated to stretch the band and exercise the intrinsic muscles of the user.

20. The apparatus of claim 19 in which said stirrup components are concavely configured to support the user's respective feet such that each said stirrup permits rotation of a supported foot against the attached exercise band when said carriage supporting said stirrup is locked in said selected set position and alternatively constrains the supported foot within said stirrup when said carriage supporting said stirrup is unlocked and during sliding of said carriage and the supported foot along said track.

* * * * *